United States Patent [19]

Oka

[11] 4,382,118

[45] May 3, 1983

[54] ELECTROPHOTOGRAPHIC MEMBER WITH TRANSPORT LAYER HAVING INORGANIC N-TYPE PARTICLES

[75] Inventor: Kozo Oka, Tokyo, Japan

[73] Assignee: Rank Xerox Limited, London, England

[21] Appl. No.: 293,898

[22] Filed: Aug. 18, 1981

[30] Foreign Application Priority Data

Aug. 21, 1980 [JP] Japan ..... 55-114049

[51] Int. Cl.[3] ..... G03G 5/14; G03G 5/04

[52] U.S. Cl. ..... 430/58; 430/57; 430/66

[58] Field of Search ..... 430/57, 58, 66, 67

[56] References Cited

U.S. PATENT DOCUMENTS

| | | | |
|---|---|---|---|
| 3,704,121 | 11/1972 | Makino et al. | 430/57 X |
| 3,801,317 | 4/1974 | Tanaka et al. | 430/57 |
| 3,816,117 | 6/1974 | Kaukeinen | 430/67 |
| 3,948,657 | 4/1976 | Yoshikawa et al. | 430/67 X |
| 4,242,432 | 12/1980 | Kato et al. | 430/57 |

*Primary Examiner*—Roland E. Martin, Jr.

*Attorney, Agent, or Firm*—Peter H. Kondo; John E. Beck; Ronald Zibelli

[57] ABSTRACT

An electrophotographic photosensitive member comprising a conductive support, a charge generating layer overlying the conductive support and a charge transport layer overlying the generating layer, the charge transporting layer comprising an electrically inactive organic resin binder having dispersed therein inorganic n-type semiconductive particles having a mean particle size below about 0.1 μm.

4 Claims, No Drawings

ELECTROPHOTOGRAPHIC MEMBER WITH TRANSPORT LAYER HAVING INORGANIC N-TYPE PARTICLES

This invention relates to an electrophotographic photosensitive member, and more particularly, to a function separated type photosensitive member which can be used in a positively charged state in an electrophotographic system known as the Carlson process.

Typical electrophotographic members which have been conventionally used include those comprising a conductive substrate having a photosensitive layer of amorphous Se, amorphous Se-Te alloys, amorphous Se-As alloys, and the like; those comprising a conductive support having coated thereon a binder material having dispersed therein an organic photoconductor such as polyvinyl carbazole (PVK)-2,4,7-trinitro-9-fluorenone (TNF), and those comprising a conductive support having coated thereon a binder material having dispersed therein an inorganic photoconductor such as CdS, ZnO, and the like. These photosensitive layers are used as a single photoconductive layer. When electrostatic latent images are formed by light exposure to cause movement of electrostatic charge formed on the outer surface of the photosensitive layer to the conductive substrate, the image quality is largely influenced by the surface condition of the photosensitive layer. Since the outer surface of photosensitive layers in electrophotographic systems can be damaged by exposure to physical and chemical conditions during the charging, developing, transferring and cleaning steps, image quality can be degraded and the life of the photosensitive layer can be reduced.

There are other known electrophotographic members wherein the function of charge generation is separated from the function of charge transport by means of a structure having a charge generating layer and a charge transporting layer laminated or coated on a conductive support. In this system, charge carriers formed in the charge generating layer by the action of light is introduced into the charge transporting layer and passes therethrough to form an electrostatic latent image. The electrostatic charge generating layer often has a lower mechanical strength than that of the charge transporting layer and is therefore susceptible to damage as compared with the latter layer. Consequently, if the photosensitive element is so constructed that the charge transporting layer is positioned as the outer layer and the charge generating layer is sandwiched between the charge transporting layer and the conducting layer, the charge generating layer is protected from damage. Further, even if the protected charge generating layer is damaged, the undesirable effects on image quality is relatively small.

Generally, materials having a high charge generating characteristic exhibit other characteristics such as high dark decay rate and low carrier mobility, i.e. low charge transporting capabilities. On the other hand, materials having a high charge transporting capability exhibit characteristics such as low charge generating capabilities. Thus, the properties of these two types of materials are contrary to each other. When the functional charge generating is separated from the function of charge transporting, the thickness of the charge generating layer can be reduced to a range that permits the charge generating layer to function without adversely affecting the performance of the entire photosensitive member. Furthermore, by having a separate charge generating layer and a charge transporting layer, properties such as sensitivity, charge acceptance, residual potential and the like can be improved. Since the charge transporting layer is essentially transparent to activating radiation having wavelengths within the spectrally sensitive range to which the charge generating layer is sensitive, the charge transporting layer can more effectively maintain a charge on the surface thereof. Further, since it is unnecessary to generate charges in the transporting layer, a material having excellent characteristics such as improved properties relating to carrier mobility, dark decay, residual potential and the like can be selected for the transporting layer. Charge transporting materials having these properties and which are transparent to visible light include known high molecular weight organic semiconductors such as polyvinyl carbazole and derivatives thereof and compositions comprising organic binders having dispersed therein low molecular weight organic semiconductors such as oxadiazole derivatives, triphenylamine derivatives, pyrazoline derivatives and the like. These charge transporting materials are of the p-type and hence can transport positive holes but cannot transport electrons. Thus, in the photosensitive members comprising a conductive support, a charge generating layer, and a charge transporting layer in which the charge transporting layer contains p-type charge transporting materials, the charging polarity of the photosensitive member should be negative. Unfortunately, the use of negative corona charging produces undesirable ozone which contributes to the deterioriation of the photosensitive member, has the potential of reaching toxic concentrations, and can cause uneven charging. It is therefore apparent, for the foregoing reasons that the realization of a separated function type photosensitive member useful in positive charging systems is highly desirable.

One approach to obtaining a function separated photosensitive member that can be used for positive charging is to employ n-type charge transporting layer which is transparent to visible light. One material proposed for this purpose comprises an organic binder layer having dispersed therein an electron attractive material such as 2,4,7-trinitro-9-fluorenone. However, materials which are satisfactory in that they have variable charge transporting properties, transparency, chemical stability and the like have yet to be obtained.

An object of this invention is to provide a photosensitive member having a charge generating layer and a charge transporting layer thereon for use in the Carlson process utilizing positive charging in which the transporting material exhibits excellent electron transporting properties, transparency and chemical stability.

This invention relates to an electrophotographic member comprising a conductive support having thereon a charge generating layer and a charge transporting layer wherein the charge transporting layer comprises an electrically inactive organic resin binder material having uniformly dispersed therein sufficient inorganic n-type semiconductor particles having a mean particle size of less than about 0.1 μm to support the injection of photogenerated electrons from the generating layer and transporting the electrons through the transporting layer.

The transporting layer containing the n-type particles of this invention is prepared by uniformly dispersing extremely fine inorganic n-type semiconductor particles having a mean particle size below about 0.1 μm in an electrically inactive organic resin binder material. Typical inorganic n-type semiconductor particles used for this purpose include ZnO, $TiO_2$, ZnS, CdS, $Zn_xCd_{1-x}S$, amorphous Si, and the like. The binding material may be selected from any suitable organic resin which is substantially transparent to visible light, is electrically inactive, has mechanical strength, will adhere to the generating layer, has sufficient surface hardness, is resistant to abrasion, and does not absorb significant amounts of water. Where solvent resistance is required, a thermosetting resin is preferred. Typical practical examples of organic resin binder materials include polyurethane resin, epoxy resin, acrylic resin, alkyd resin, polyester resin, polycarbonate resin, silicone resin, vinyl chloride-vinyl acetate resin, fluorinated resin, butadiene rubber, and the like. The ratio of the inorganic n-type semiconductor to the electrically inactive organic resin binding material in the charge transporting layer is preferably from about 10:90 to about 80:20 by weight. The thickness of the charge transporting layer is preferably from about 5 μm to about 60 μm.

The charge generating layer used in this invention may comprise a vapor-deposited layer of an inorganic photoconductive material such as amorphous Se, amorphous Se-Te alloy, amorphous Se-As alloy, CdSe, CdSeTe, CdTe, CdS, ZnS, trigonal Se, and the like. Alternatively, the charge generating layer may comprise a layer of a binding material having dispersed therein the inorganic photoconductive materials described above. The generating layer may, instead, comprise a layer of a binding material having dispersed therein an organic photoconductive material such as a phthalocyanine pigment, a triazo pigment, a cyanine pigment, a disazo pigment, indigoid pigment, or the like. The thickness of the charge generating layer is preferably from about 0.1 μm to about 5 μm.

Any suitable conductive support may be employed in this invention. Typical conductive supports include metals such as aluminum, copper, nickel, and the like; resin films coated with a conductive coating such as carbon dispersed in a binder; and paper treated with conductive organic or inorganic materials. If desired, an interlayer may be employed between the conductive support and the charge generating layer to prevent charge injection and to improve the adhesion between the conductive support and the charge generating layer.

Inorganic n-type semiconductors exhibit thermal and chemical stability. Consequently, charge transporting layers having the inorganic n-type semiconductive particles dispersed therein are also durable, thermally and chemically stable, exhibit mechanical strength and have a very long life. Further, the photosensitive member of this invention may be made in flexible form for use either in the shape of a drum or belt.

The present invention will be described in more detail in the following Examples.

EXAMPLE I

A charge generating layer having a thickness of about 0.5 μm is formed on a conductive support by vapor deposition of a layer of Se-Te alloy. About 100 parts by weight of ZnO powder having a mean particle size of about 0.08 μm is dispersed in about 65 parts by weight of a polyester resin (Bylon 200 manufactured by Toyobo Company, Ltd.) and about 100 parts by weight of dichloromethane for about 70 hours in a ball mill. Cyclohexanone is then added to the dispersion in a sufficient amount to precoat the mixture on the generator layer. After drying, the resulting electrophotographic member is repeatedly imaged by the Carlson technique involving the steps of charging, exposure, development, transfer and cleaning. Good copy images are obtained.

EXAMPLE II

About 3 parts by weight of phthalocyanine (manufactured by Toyo Inc. Manufacturing Company Ltd.) is mixed with about 10 parts by weight of polyurethane resin (Retan 4000 manufactured by Pansai Paint Company, Ltd.) and about 100 parts by weight of acetic n-butyl acetate for about 5 hours in a ball mill. The resulting mixture is spray coated on a conductive support to form a charge generating layer having a thickness of about 1 μm. About 100 parts by weight of $TiO_2$ powder having a mean particle size of about 0.04 μm is dispersed in about 60 parts by weight of a polyurethane resin (Retan 4000, manufactured by Kansai Paint Company, Ltd.) and about 80 parts by weight of cellosolve acetate for about 65 hours in a ball mill. The dispersion is spray coated on the generating layer to form a charge transport layer having a thickness of about 20 μm. When the resulting electrophotoconductive member is subjected to the Carlson imaging steps described in Example I, good copy images are obtained.

The invention has been described in detail with particular reference to preferred embodiments thereof, but it will be understood that variations and modifications of the present invention will be understood by those skilled in the art upon a reading of the disclosure. These are also intended to be within the scope of the present invention.

What is claimed is:

1. An electrophotographic photosensitive member comprising a conductive support, a charge generating layer overlying said conductive support and a charge transporting layer overlying said generating layer, said charge transporting layer being substantially transparent to activating radiation having wavelengths within the spectrally sensitive range to which said generating layer is sensitive and comprising an electrically inactive organic resin binder material having uniformly dispersed therein inorganic n-type semi-conductive particles having a mean particle size below about 0.1 um and capable of supporting the injection of photogenerated electrons from said generating layer and transporting said electrons through said transporting layer.

2. The electrophotographic photosensitive member according to claim 1 wherein the ratio of said inorganic n-type semiconductor particles to said electrically inactive organic resin binder material is from about 10:90 to about 80:20 by weight.

3. The electrophotographic photosensitive member according to claim 2 wherein said charge transporting layer has a thickness from about 5 μm to about 60 μm.

4. The electrophotographic photosensitive member according to claim 3 wherein said charge generating layer has a thickness from about 0.1 μm to about 5 μm.

* * * * *